United States Patent [19]

Rogers et al.

[11] Patent Number: 4,487,031

[45] Date of Patent: Dec. 11, 1984

[54] METHOD AND APPARATUS FOR CONTROLLING COMPRESSOR CAPACITY

[75] Inventors: Richard D. Rogers, East Syracuse; Harold H. Hopkinson, Manlius, both of N.Y.

[73] Assignee: Carrier Corporation, Syracuse, N.Y.

[21] Appl. No.: 540,268

[22] Filed: Oct. 11, 1983

[51] Int. Cl.[3] ..... F25B 13/00

[52] U.S. Cl. ..... 62/160; 62/175; 62/228.3

[58] Field of Search ..... 236/1 EA; 62/160, 175, 62/228.3, 226, 228.5; 237/2 B

[56] References Cited

U.S. PATENT DOCUMENTS

| | | | |
|---|---|---|---|
| 3,513,662 | 5/1970 | Golber | 62/175 X |
| 4,346,755 | 8/1982 | Alley et al. | 62/160 X |
| 4,384,462 | 5/1983 | Overman et al. | 62/175 |

*Primary Examiner*—William E. Wayner

*Attorney, Agent, or Firm*—David J. Zobkiw

[57] ABSTRACT

A method and apparatus for effecting capacity control of a compressor are described. A compressor having multiple capacity steps is utilized. A control valve being connected to both the compressor discharge pressure and the compressor suction pressure as well as heating and cooling pressure sensors is utilized. The control valve acts to connect appropriate pressure to the pressure sensors such that a variation in pressure level beyond a predetermined range effects a pressure sensor change indicating a need to change the capacity level of the compressor. Upon the capacity level of the compressor being changed the control valve is cycled to apply an opposite pressure level to the pressure sensor to reset the pressure sensor such that the pressure sensor may again detect a change in the pressure level to indicate a further need for a capacity change in the compressor.

19 Claims, 5 Drawing Figures

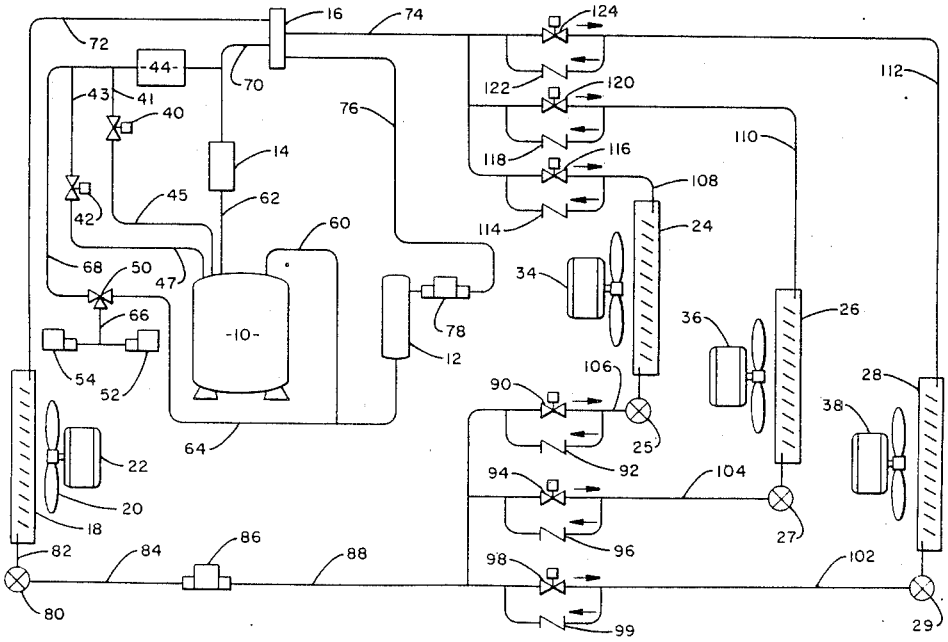

METHOD AND APPARATUS FOR CONTROLLING COMPRESSOR CAPACITY

BACKGROUND OF THE INVENTION

1. Field of the Invention

The present invention relates to refrigeration circuits. More specifically, the present invention concerns the utilization of resetable pressure sensing switches to effectively regulate the capacity of a variable capacity compressor within a refrigeration circuit.

2. Prior Art

To effectively utilize an air conditioning system it is desirable to match the compressor output to the load on the system. Matching compressor output to the load on the system has been accomplished in many ways. One way is to operate the compressor motor at separate speeds thereby pumping separate amounts of refrigerant at each speed. Another way is to use valve unloaders and bypass means to limit the number of cylinders effectively pumping refrigerant within the compressor. A hot gas bypass wherein some of the discharge gas is circulated back to the compressor suction is another method of limiting compressor output. In centrifugal compressors, guide vanes are utilized to control the flow of refrigerant gas into the compressor to regulate the output by controlling the input.

The present invention is particularly concerned with a reciprocating type compressor capable of having varying refrigerant outputs in discrete stages. These outputs are controlled via unloader valves which effectively operate to render inoperative, in terms of pumping refrigerant, at least one of a pair of reciprocating pistons. To more effectively regulate the flow of refrigerant from the compressor, these individual pistons may be chosen to have varying displacements such that rendering one inoperative reduces refrigerant flow by a substantially different amount then rendering the other inoperative. Via this arrangement, a compressor having three capacity steps may be achieved by having two varying sized pistons. For a complete description of such a compressor and the control system therefor, please see U.S. patent application, Ser. No. 479,044, entitled "Variable Volume Compressor And Method Of Operating", filed Mar. 25, 1983.

In split system air conditioning units, the compressor and condenser are typically located remote from the indoor heat exchanger. In such a system it would be advantageous, in terms of energy consumption, to have a multiple capacity compressor. In split systems having multiple indoor heat exchangers serviced by a single compressor and a single condenser, the advantages of utilizing a variable capacity compressor are further increased. Such a system might typically include three indoor heat exchangers connected to a single compressor and a single condenser. The number of operating stages of the compressor could be matched to the number of indoor heat exchangers such that the load on the system may be balanced simply by selecting the appropriate stage of the compressor for the number of heat exchangers being operated. Such a system, however, is overly simplistic and, depending upon the various operating conditions of the separate indoor heat exchangers, may result in the compressor working too hard and wasting energy or being at a capacity stage which is sufficient to meet the load on just a partial number of indoor coils. For instance, should the outdoor ambient temperature be extremely high and only two indoor coils be calling for cooling (the third being shut down because the space is not being utilized) the compressor may need to operate in its highest capacity step as opposed to a lower capacity step to satisfy the load on just two indoor coils.

On the other hand, should the outdoor ambient temperature be relatively low and all three indoor fan coils are calling for cooling because of humidity conditions of the spaces being occupied, then the operation of the compressor at its highest capacity step may not be required to meet the cooling load.

The current device as disclosed herein utilizes capacity pressure sensors to determine when pressure levels have been reached. Specifically, a heating capacity pressure sensor is utilized and is connected to the compressor discharge line to sense the discharge pressure from the compressor. The heating capacity pressure sensor uses a switch arranged to move from a first state to a second state upon the pressure level being sensed exceeding a predetermined value. Hence, when the compressor discharge pressure exceeds the predetermined level of the heating capacity pressure sensor, the sensor changes from a first state to a second state indicating a need to reduce the compressor capacity. To reset the heating capacity pressure sensor, the sensor is subjected to low pressure to change the sensor from the second state back to the first state. The sensor is now in position to detect another variation above the preset pressure level. Between the heating capacity compressor sensor tripping and before the pressure sensor is again connected to sense the discharge pressure, the capacity of the compressor is reduced. As outlined in this herein application, a three state or three capacity step compressor is disclosed. If the compressor is operating at high capacity and the heating capacity pressure sensor indicates too much capacity is present, the compressor will be cycled to the next lower or midlevel capacity.

With the compressor operating in the midcapacity step should the heating capacity pressure sensor again detect a pressure level above the preset level then the sensor will again trip and the compressor will be cycled to the low capacity step.

A cooling capacity pressure sensor may also be utilized being set to trip upon the suction pressure to the compressor falling below a predetermined level. This sensor works similarly to the heating capacity pressure sensor in that upon the pressure falling below the predetermined level it changes from a first state to a second state. The capacity step at which the compressor is operated is decreased in response to the sensor tripping and the sensor is then reset by exposing the sensor to the relatively high discharge pressure from the compressor for a short interval. The cycle is then begun again with the compressor at the midcapacity stage. Should another pressure drop below the predetermined level be detected, the cycle will commence again and the compressor will then be operated in the low capacity stage.

A single control valve connected to the compressor suction line and discharge line as well as being connected by a sensing conduit to both the heating capacity pressure sensor and the cooling capacity pressure sensor acts to cycle the appropriate pressures therebetween. The valve is arranged to connect the two pressure sensors to either the relatively high pressure compressor discharge line or the relatively low pressure compressor suction line. One advantage of the herein system is that by utilizing a single control valve, only two pressure sensors, one for heating and one for cooling, are necessary. It is extremely difficult to calibrate pressure sensors at slightly different pressure levels such that the use of a series of pressure sensors staged separately from one another to control the various capacity stages of the compressor is unobtainable at a commercially acceptable expense. Additionally, the use of multiple pressure sensors is expensive and can create numerous calibration problems. The herein system utilizes a single control valve to appropriately connect pressures to both the sensors. The single control valve additionally acts to reset the pressure sensors by communicating the appropriate discharge or suction pressures to the valve to effect reset. Additionally, since the two sensors operate in distinct pressure level regions, one at high pressure and one at low pressure, a single connecting line serves both, one being rendered essentially ineffective by the pressure within the system being in the pressure range detected by the other sensor and outside the pressure range detected by the ineffective sensor. In addition, the electronic control is programmed to only sense signals from the appropriate pressure sensor for the mode of operation of the system.

SUMMARY OF THE INVENTION

It is an object of the present invention to provide a refrigeration circuit incorporating a variable step compressor capacity control.

It is another object of the present invention to utilize pressure sensors for effecting capacity control of a compressor.

It is a still further object of the present invention to incorporate a single pressure sensor for regulating changes between multiple capacity steps of a compressor.

It is a yet further object of the present invention to incorporate a single control valve for regulating suction and discharge pressure supplied to both a heating capacity pressure sensor and a cooling capacity pressure sensor.

It is another object of the present invention to provide a safe, economical and reliable method of switching compressor capacity steps.

It is a further object of the present invention to provide a safe, economical and reliable, easy to install and manufacture control for a variable step compressor.

Other objects will be apparent from the description and the appended claims.

The above objects are achieved according to the preferred embodiment of the invention by the provision of a refrigeration circuit including an outdoor heat exchanger, an indoor heat exchanger and variable capacity compressor means. A discharge line connected to the variable capacity means for receiving refrigerant at high pressure and a suction line connected to the compressor means for conducting refrigerant to the compressor at a relatively lower pressure and means for changing the capacity of the compressor means which comprises a capacity pressure switch means indicating a need to effect a change in the capacity of the compressor upon a selected refrigerant pressure level being detected, a control valve connected via a high pressure conduit to direct refrigerant between the discharge line and the control valve, connected via a low pressure conduit to direct refrigerant between the suction line and the control valve and a sensing conduit connecting the control valve to the capacity pressure switch means, said control valve acting to connect either the high pressure conduit to the sensing conduit or to connect the low pressure conduit to the sensing conduit; and a control means interconnected to effect a change in the capacity of the compressor means upon the capacity pressure switch means indicating a need to effect a change in the capacity of the compressor means.

A reversible refrigeration circuit for transferring heat energy between an outdoor heat exchanger and an indoor heat exchanger including a variable capacity compressor for circulating the refrigerant through the refrigeration circuit, a reversing valve, a discharge line for receiving high pressure refrigerant from the compressor and a suction line for conducting low pressure refrigerant to the compressor is additionally disclosed. A high pressure conduit connected to the discharge line; a low pressure conduit connected to the suction line; a heating capacity pressure switch which changes from a first state to a second state upon detecting a predetermined pressure level to indicate a need to change the capacity of the compressor; a cooling capacity pressure switch which changes from a first state to a second state upon detecting a predetermined pressure level to indicate the need to change the capacity of the compressor and a sensing conduit connected to both the heating pressure switch and the cooling pressure switch are further described. A control valve is connected to the high pressure conduit, low pressure conduit and the sensing conduit to connect either the low pressure conduit or the high pressure conduit to the sensing conduit. Control means are then provided for regulating the position of the control valve and the capacity of the compressor in response to the position of the heating capacity pressure switch and the cooling capacity pressure switch.

Additionally, a method of regulating the capacity of a variable compressor forming a portion of a refrigeration circuit is disclosed. Said compressor discharges high pressure refrigerant and receives low pressure refrigerant. The method includes the steps of sensing a pressure level within the refrigeration circuit; indicating a need to effect a compressor capacity change based upon the sensed pressure level not being within the desired pressure range; changing the capacity of the compressor in response to the step of indicating; and resetting the step of sensing after the step of changing such that a further capacity change may be effected based upon the sensed pressure level not being within said desired pressure range.

Additionally, disclosed is a method using a single level pressure sensor for regulating the capacity of a multiple capacity compressor having a discharge line at relatively high pressure and a suction line at a relatively low pressure all part of the refrigeration circuit. The steps include applying a pressure level from either the discharge line or the suction line to the pressure sensor; determining if the pressure sensor changes from a first state to a second state indicating that a predetermined pressure level has been exceeded and that there is a need to change the capacity of the compressor; regulating the compressor capacity in response to the state of the pressure sensor; and coupling a pressure level from either the suction line or the discharge line to the pressure sensor to reset the sensor from the second state to the first state such that a subsequent need to change the compressor capacity may be detected by the sensor determining if the same pressure level has been exceeded.

DESCRIPTION OF THE PREFERRED EMBODIMENT

The embodiment as described herein is adapted for use in a split system multi-evaporator unit having three indoor heat exchangers and a single condenser. It is contemplated that the three indoor heat exchangers would be mounted in separate rooms, that the condenser or outdoor heat exchanger would be mounted exterior of the space to be conditioned and that a third unit including the compressor and valves would be located in a separate enclosure. It is to be understood that this invention has like applicability to other types of air conditioning systems including those only having a single evaporator or indoor heat exchanger and those wherein the components are arranged in other configurations.

As used herein, reference is made to changing the capacity of the compressor between several states. It is further to be understood that although the specific compressor control arrangement disclosed incorporates three capacity states that this invention has like applicability to other numbers of capacity states as well as to continuously variable capacity compressors. It is further to be understood that this invention is not limited to the manner in which the capacity states are controlled such as by suction valve regulation, hot gas bypass, motor speed control, inlet guide vanes or other similar devices.

Additionally, the language herein will continually refer to a change in the pressure level acting to effect conditions detected by a pressure sensor. This change in pressure level may be either upwardly or downwardly and the language indicating a change in the pressure level or similar terms may be utilized both to include the discharge pressure level increasing as in heating to indicate a need for a capacity step reduction or the suction pressure decreasing as in cooling to indicate a need for a capacity step reduction.

Figure 1:
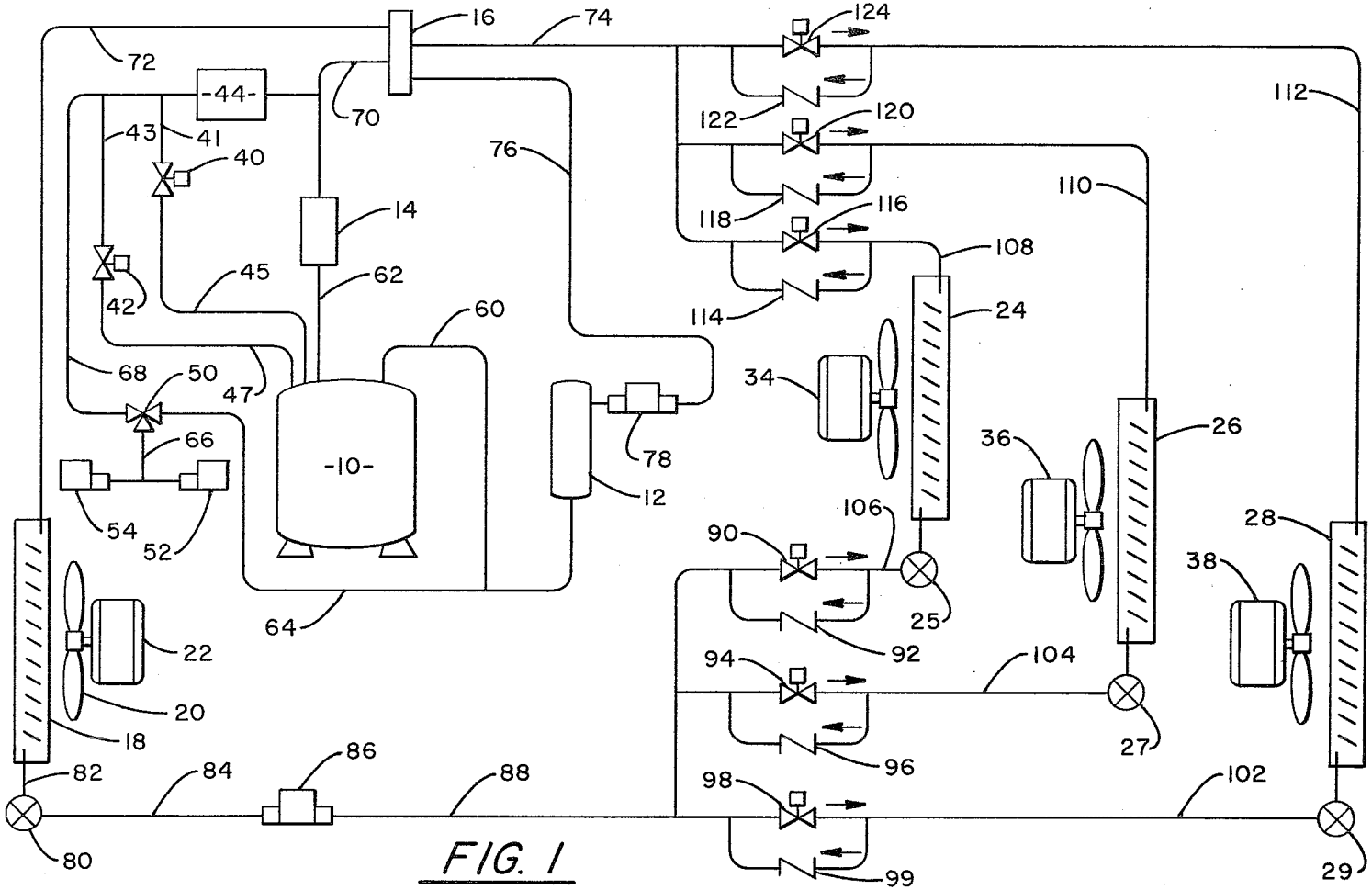
FIG. 1 is a schematic drawing of a refrigeration circuit.

Referring now to FIG. 1, there may be seen a schematic drawing of a refrigeration circuit. Compressor 10 is connected to discharge line 62 for discharging refrigerant at high pressure. The compressor receives refrigerant at low or suction pressure through suction line 60. Compressor discharge line 62 is connected to muffler 14 which is connected via conduit 70 to reversing valve 16 and to strainer 44. From strainer 44 via conduit 41 first unloader 40 is connected via conduit 45 back to the compressor. Additionally, from strainer 44 via conduit 43 second unloader 42 is connected via conduit 47 back to the compressor. When energized, the solenoid for each unloader valve opens the unloader supplying high pressure from the compressor discharge back to the unloader elements in the compressor to effectively unload one or the other of two compressor cylinders. Hence, if the first unloader is energized, the cylinder corresponding thereto is de-energized affecting the capacity of the compressor. The same applies to the second unloader which would act to de-energize the second cylinder in the compressor. Since the pistons within the compressor may be sized such that one alone acts to supply $\frac{1}{3}$ the capacity and the other portion supplies $\frac{2}{3}$ of the capacity, then by staging which unloader is energized the capacity levels of $\frac{1}{3}$, $\frac{2}{3}$ and full capacity may be obtained utilizing these two unloaders. Conduit 72 connects reversing valve 16 to outdoor heat exchanger 18. Outdoor fan 20 connected to outdoor fan motor 22 acts to circulate air in heat exchange relation with refrigerant flowing through outdoor heat exchanger 18. Connected to outdoor heat exchanger 18 is conduit 82 which is connected to combination expansion device and check valve 80 and via conduit 84 to high pressure switch 86 and then to conduit 88. Conduit 88 is connected to liquid line solenoid 90, check valve 92, liquid line solenoid 94, check valve 96, liquid line solenoid 98 and check valve 99. Conduit 106 connects liquid line solenoid 90 and check valve 92 through expansion device 25 to indoor heat exchanger 24. Likewise, conduit 104 connects solenoid 94 and check valve 96 via expansion device 27 to indoor heat exchanger 26. Conduit 102 connects solenoid 98 and check valve 99 via expansion device 29 to indoor heat exchanger 28. Indoor fan motors 34, 36 and 38 are connected to indoor fans and act to circulate air through indoor heat exchangers 24, 26 and 28, respectively. Conduit 108 connects indoor heat exchanger 24 to suction line solenoid 116 and check valve 114. Conduit 110 connects indoor heat exchanger 26 to suction line solenoid 120 and check valve 118. Conduit 112 connects indoor heat exchanger 28 to suction line solenoid 124 and check valve 122.

Conduit 74 connects the reversing valve with suction solenoid valves 124, 120, 116 and to check valves 122, 118 and 114. Reversing valve 16 is also connected via conduit 76 through low pressure switch 78 to accumulator 12. Accumulator 12 is connected by suction line 60 to compressor 10.

The control portion of the refrigeration circuit for effecting capacity changes in the compressor includes high pressure conduit 68, low pressure conduit 64, sensing conduit 66, control valve 50 and heating capacity pressure sensor 54 and cooling capacity pressure sensor 52. Low pressure conduit 64 is connected between the compressor suction line 60 and control valve 50. High pressure suction conduit 68 is connected between strainer 44, connected to the compressor discharge line 62 through the muffler 14 and to control valve 50. Control valve 50 is connected to sensing conduit 66 which is connected to both the heating capacity pressure sensor and the cooling capacity pressure sensor.

OPERATION OF THE REFRIGERATION CIRCUIT

In the cooling mode of operation, the compressor acts to discharge high temperature and pressure gaseous refrigerant through the discharge line, through reversing valve 16 and through condenser 18 wherein refrigerant changes state from a gas to a liquid. Liquid refrigerant is then cycled through the appropriate liquid line solenoids, 90, 94 and 98, to indoor heat exchangers 24, 26 and 28. Therein refrigerant evaporates changing state from a liquid to a gas absorbing heat energy from the air to be cooled. The gaseous refrigerant is then circulated through check valves 122, 118 and 114, back through reversing valve 16 to the accumulator and through the suction line to the compressor.

Control valve 50, may be a three-way valve formed from a pilot valve of a reversing valve with one of the four openings simply soldered shut to form a three-way valve. Control valve 50 in the cooling mode of operation acts to connect the low pressure from suction line 64 to the sensing conduit 66. The cooling capacity pressure sensor 52 then acts to determine whether or not the pressure in the suction line drops below a predetermined value. Should the pressure drop below such a value, then the cooling capacity pressure sensor will switch state from a second state to a first state. A control circuit will detect this switch in state and will then effect a change in the capacity of the compressor by changing the unloader valves 40 and 42. Assuming the compressor is operating in the high capacity stage, as it always operates when started up, then upon detecting this reduced pressure after a time interval, the cooling capacity pressure sensor will indicate the need to effect a change in the capacity compressor and the controls will act to energize first unloader valve 40 to reduce the capacity of the compressor to the mid-level capacity. The control valve 50 will remain in the same position during this time interval applying a low pressure level from the compressor suction line to the cooling capacity pressure sensor. Once the unloader valve is energized to change the capacity of the compressor the control valve is repositioned to the opposite position for a time interval such as 20 seconds such that high pressure from the compressor discharge line is supplied to the cooling capacity pressure sensor. This high pressure acts to reset the cooling capacity pressure, sensor such that it changes state back to the second state from the first state. After this change period is over, the compressor operates in the midcapacity level and unless the cooling capacity pressure sensor again detects a drop in suction pressure below the preset level, will continue to operate. Should the additional drop in pressure below the preset level be detected then the cycle will begin again and the unloader valve 42 will be energized and unloader valve 40 will be de-energized such that the compressor is then operated in the low capacity state. The control valve will then be cycled for 20 seconds to the opposite position to provide high pressure to the cooling capacity pressure sensor to reset the cooling capacity pressure sensor to the first state.

In the heating mode of operation, the refrigeration circuit operates as a heat pump as is commonly known. The refrigerant flows through the indoor heat exchangers opposite the manner previously described in the cooling mode of operation. In this mode, reversing valve 16 is switched such that hot gaseous refrigerant from the compressor is directed first through solenoid valves 124, 120 and 116 and then to indoor heat exchangers 24, 26 and 28 where it is condensed from a gas to a liquid giving up its heat of condensation to the air to be heated. Liquid refrigerant then flows through check valves 92, 96 and 99 to the outdoor heat exchanger 18 now acting as an evaporator. From there refrigerant flows back through reversing valve 16 to the compressor suction line to the compressor.

In the heating mode of operation, the control valve is energized to be placed in the opposite position from the cooling mode of operation. In this mode of operation, the high pressure level from the discharge of the compressor is communicated with the heating capacity pressure sensor. Should the heating capacity pressure sensor detect an increase in this pressure level above a predetermined level then the heating capacity pressure sensor will change from the first state to the second state indicating a need to reduce the capacity of the compressor. In response to this indication, the unloader valve will be energized and the control valve will be repositioned for 20 seconds to apply low pressure from the compressor suction line to reset the heating capacity pressure sensor. This low pressure acts to reset the heating capacity pressure sensor from a second state to a first state such that upon continuation of refrigeration circuit operation an additional need to effect a further decrease in the heating capacity may be similarly detected.

Figure 2:
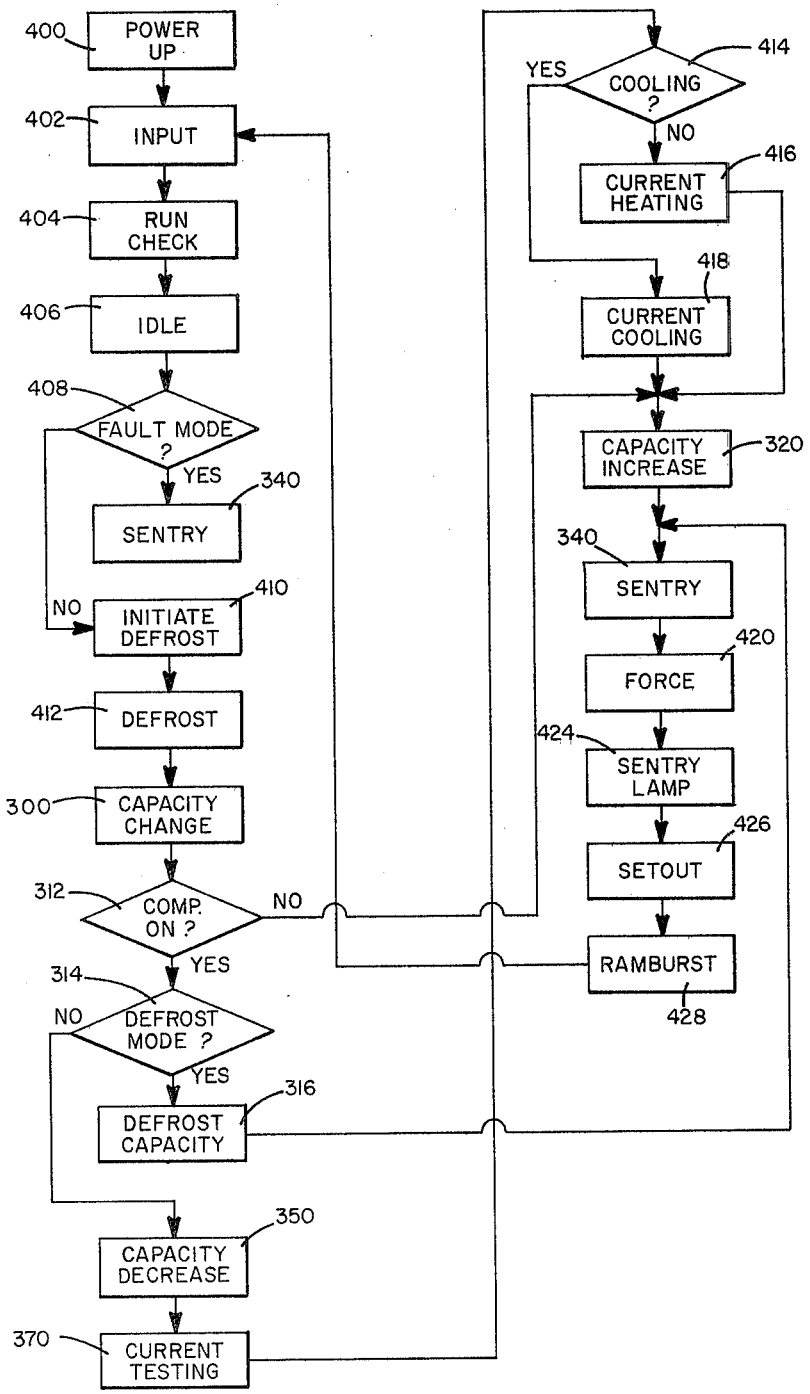
FIG. 2 is a flow chart outlining the overall logic of a microprocessor control regulating an air conditioning unit.

FIG. 2 is a flow chart indicating the overall operation of the control system. It can be seen that the overall system control is obtained by logic flow through a series of logic steps. Each logic step may represent a subroutine or a series of steps omitted for clarity in this overall chart. The initial step 400 is powerup of the unit upon energization. Thereafter, at step 402 the various inputs are sensed. To make sure the inputs are stabilized and debounced, a powerup delay occurs before proceeding to run check step 404. Step 406 places the control in the idle mode of operation. From there logic flows to determining whether or not the system is in a fault mode. If the answer to question in 408 is whether the system is in a fault mode is yes the logic then proceeds to step 340, known as the sentry step. This step may be seen additionally down toward the bottom of the flow chart and is an identical step. If the answer to whether or not a fault present in step 408 is no, the logic then proceeds to step 410 to initiate defrost.

Step 412 is the actual defrost operation. Upon completion thereof logic flows to the step of capacity change 300. At step 300 the logic flows to ask whether or not the compressor is energized. If the answer is no, the logic flows to step 320 for capacity increase. If the answer to the question at step 312 is yes, the logic flows to ask whether or not the unit is in the defrost mode of operation at step 314. If the answer to that question is yes, the unit moves into step 316, defrost capacity and from there to sentry step 340. If the answer to the question whether or not the unit is in the defrost mode at step 314 is no, the logic flows to step 350, capacity decrease. From capacity decrease the logic flows to step 370 for current testing. From there the logic flows to ask whether or not the unit is in the cooling mode of operation at step 414. If the answer to this question is no the logic flows to current heating step 416 and from there to capacity increase step 320. If the answer to the question at step 414 is yes, the logic flows from step 414 to the current cooling step 418. From there the logic flows to the capacity increase step 320. From capacity increase the logic flows to sentry step 340 and from there to force step 420, sentry lamp step 424, set out step 426, ram burst 428 and back to input 402. Hence, there is seen an outline of the overall logic flow of the operating control for this unit.

Figure 3:
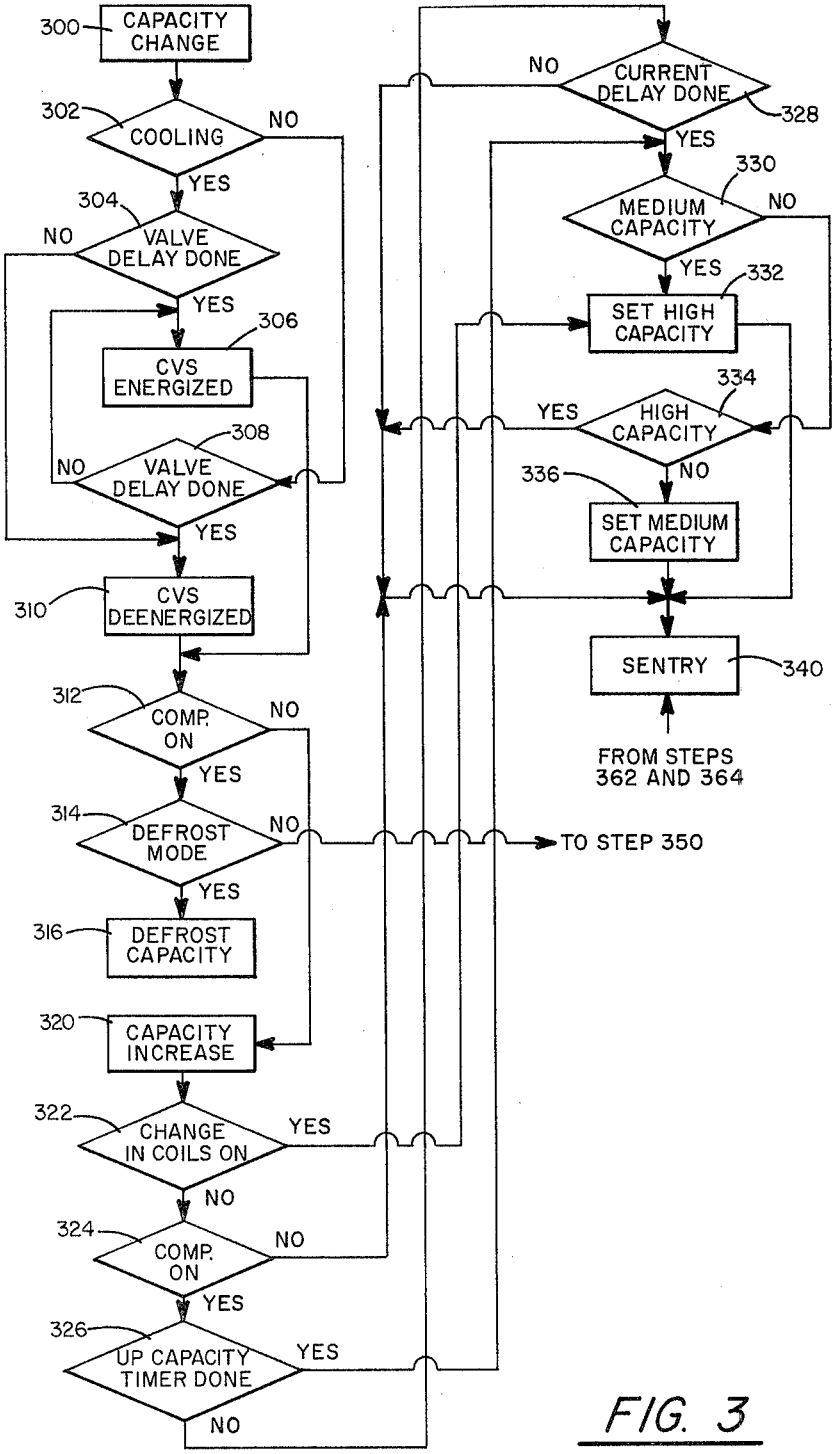
FIGS. 3 and 3A are flow charts of the capacity change subroutine including capacity increase and decrease portions of the microprocessor logic for controlling those functions.
Figure 3A:
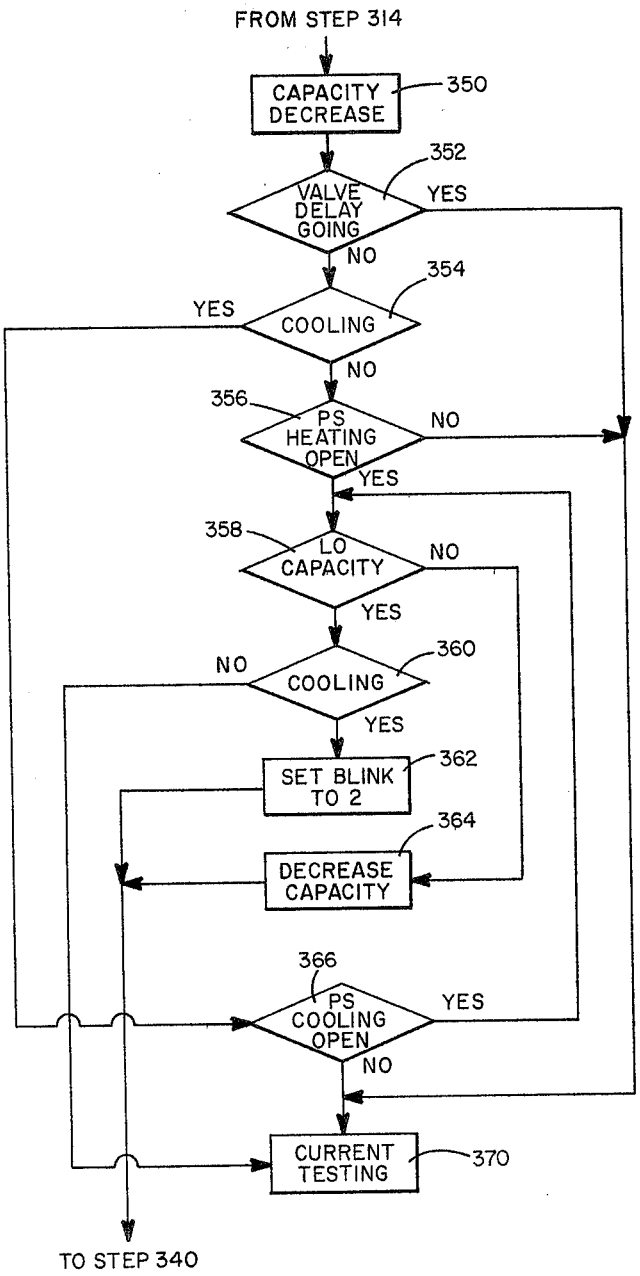

FIGS. 3 and 3A are flow charts detailing the capacity change logic in the control including capacity increase and capacity decrease. A portion of this logic has been shown in FIG. 2 in the overall flow chart.

Commencing at step 300, capacity change, the steps in FIG. 3 being labeled in numerical order such that they coincide with the steps labeled out of numerical order in FIG. 2. The logic flows from the step of capacity change 300 to step 302 to ask whether or not the unit is in the cooling mode of operation. If the answer to the question in step 302 is no the logic flows to step 308 to determine whether or not the control valve delay is done. The control valve corresponds to control valve 50 in the refrigeration circuit. The control valve delay is a delay period such as five minutes of continuous operation at a compressor capacity level before commencing pressure sensing. During this period the control valve is rendered inoperative and no pressure levels are sensed. If the control valve delay is done the logic then proceeds to the step of de-energizing the control valve step 310. This acts to place the control valve in position such that high pressure conduit 68 is connected to sensing conduit 66 for supplying high pressure to the heating capacity pressure sensor 54.

If the answer at step 302 as to whether or not the unit is in the cooling mode of operation is yes the logic flows to step 304 to ask if the control valve delay is done. If the answer to whether the control valve delay is done is no the logic flows to step 310 to maintain the control valve solenoid de-energized. If the answer to step 304 indicating the control valve delay is done and that the unit is in the cooling mode of operation the control valve solenoid is then energized at step 306 to place the low pressure conduit 64 in communication with the cooling capacity pressure sensor 52 via sensing conduit 66. Hence the portion of the logic described so far asks to place the control valve in the appropriate position after the intial time delay is done to assure the appropriate pressure level is being sensed.

At step 312 the logic asks the question whether or not the compressor is operating. If the answer at this step is no the logic flows to step 320 to the capacity increase subroutine. If the answer at step 312 is yes the logic flows to step 314 to determine whether or not the unit is in the defrost mode of operation. If the answer at step 314 is yes the logic flows to defrost capacity step 316 as may be found in the flow chart in FIG. 2.

If the answer to the question at step 314 whether or not the unit is in the defrost mode of operation is no the logic then flows to the capacity decrease subroutine labeled 350 and shown on FIG. 3A.

The capacity increase subroutine 320 includes the logic flowing to step 322 to ask whether or not there is a change in the number of coils on. This step means, has there been an additional indoor heat exchanger energized from the previous time that the question was asked. It is contemplated that each of the three indoor heat exchangers would have separate controls so that they may be manually energized at any time. If an additional heat exchanger has been energized and the answer to the question is yes, the logic flows to step 332 to set the compressor in high capacity. Hence, upon any increase in the number of heat exchangers being operated the compressor is automatically set at high capacity.

Should the answer to the question asked in step 322 be no, the logic flows to step 324 to ask whether or not the compressor is energized. If the compressor is energized the logic flows to step 326 to ask if the up capacity timer has timed out. The up capacity timer is a timer set to operate for approximately 30 minutes. If the unit has been operating for 30 minutes indicating a cooling or heating need for that period and has not satisfied that cooling or heating need then it is desirable to have the compressor automatically increase a capacity step. Hence, if the up capacity timer is done and the 30 minute time delay has lapsed then the logic flows from step 326 to step 330 to ask if the unit is in the medium capacity step. If the answer is yes the logic then flows to step 332 to set the unit in a high capacity step. If the answer is no the logic then flows to ask if the unit is in high capacity at step 334. If the answer to this question is yes the logic then flows to sentry step 340. If the answer is no indicating that the unit is neither in the medium capacity nor the high capacity then it is obvious that the unit is in the low capacity. Hence, the logic then flows to step 336 to set the unit in the medium capacity step. From the medium capacity step 336 the logic flows to sentry 340 and back to the overall flow chart as shown in FIG. 2.

If the answer to the question of whether or not the up capacity timer has elapsed at step 326 is no logic then flows to step 328 to ask whether or not the current delay is done. Step 328 indicates that the current value of the compressor motor is monitored after an initialization period. If the current of the compressor motor varies from the monitored amount a predetermined amount then it is desirable to increase the capacity of the compressor. Typical values for the step might be if the current of the compressor in the cooling mode of operation falls below 87 ½% of the current when started then it is time to initiate increased capacity operation. In the heating mode of operation should the current exceed the initialization current by more than 106.25% after a five minute delay period then it is likewise time to initiate a higher capacity step operation. In either of these events, if the answer to the question at step 328 is yes then the logic flows on to step 330 as previously described. If the answer at step 328 is no the logic then flows to sentry step 340.

The logic flows to capacity decrease subroutine 350 from step 314 when the compressor is on and the unit is not in the defrost mode of operation. The logic then flows to step 352 where the question is the valve delay going is asked. This valve delay is the delay when switching between capacity steps and may be for a period such as twenty seconds. If the answer to step 352 is yes the logic flows to step 370, current testing. If the answer to step 370 is no indicating no on going delay the logic then flows to step 354.

At step 354 the question of whether or not the unit is in the cooling mode of operation is asked. If the answer is no the logic flows to step 356 to ask whether or not the heating capacity pressure sensor is open. If the heating capacity pressure sensor is open indicating that the pressure level necessary to effect a reduction in the capacity of the compressor in the heating mode of operation has not been achieved then the logic flows to current testing step 370. If, on the other hand, the answer to the question in step 356 is yes the logic flows to step 358 wherein the question of whether or not the unit is operating in low capacity is asked. If the answer to this question is no the logic then flows to step 364 to decrease capacity and from there to sentry, step 340. If the answer is that the unit is already in the low capacity the logic flows to step 360 and if the unit is in the cooling mode of operation to step 362 to indicate a fault (set blink of a warning light) or if in the heating mode of operation onto current testing step 370.

If the answer to the question at step 354 is yes the logic flows to step 366 where the question of whether the cooling pressure sensor switch is open. If the switch is open the logic flows to logic step 358 to effect a capacity decrease. If the answer at step 366 is no the logic flows to step 370, current testing. The above has been a description of the operation of the logic within the microprocessor control of the system.

Figure 4:
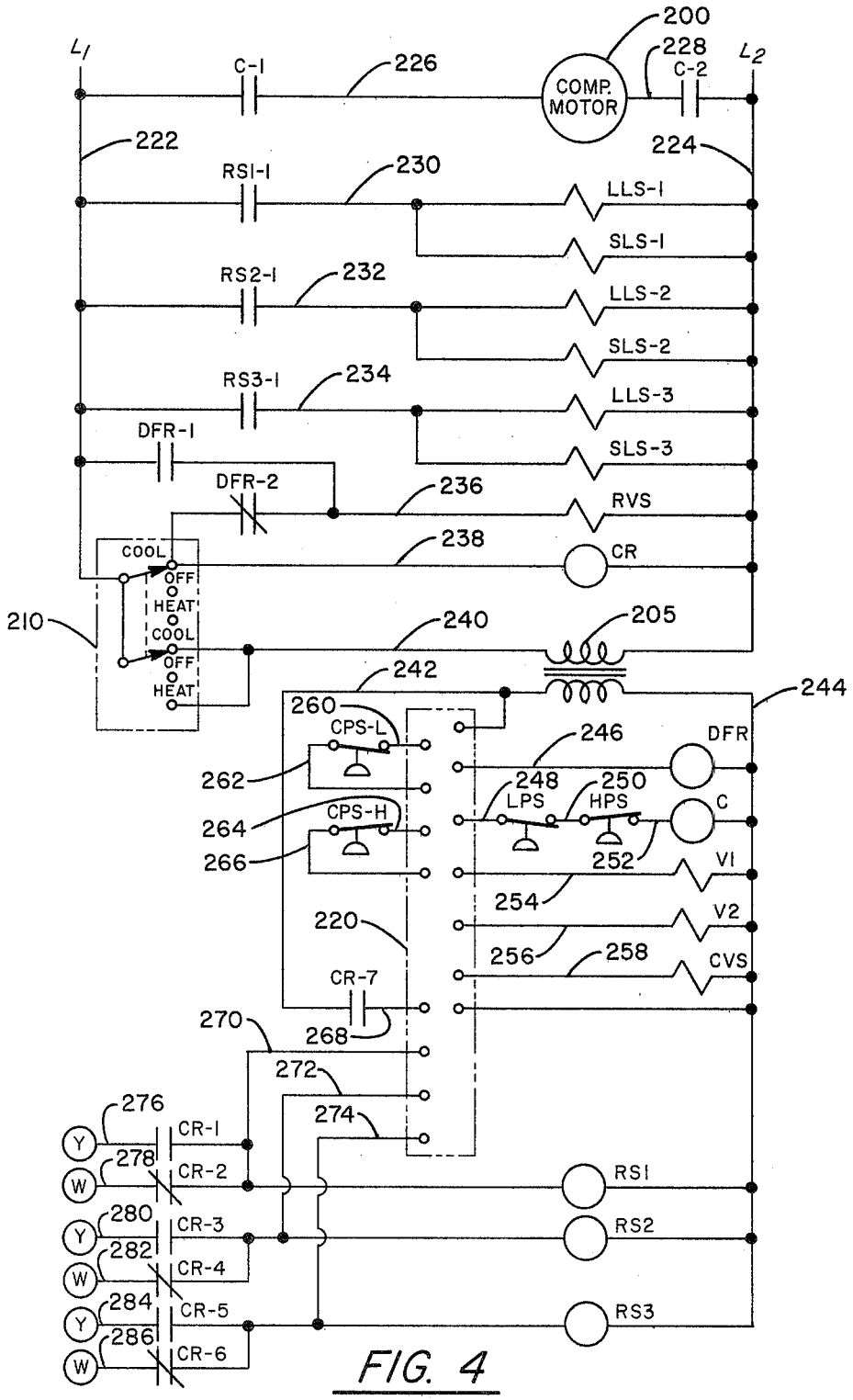
FIG. 4 is an electrical schematic diagram showing the interrelationships between the microprocessor and the various components of the refrigeration circuit.

FIG. 4 is an electrical schematic of a wiring diagram as may be used with a multiple indoor heat exchanger split system air conditioning unit in utilizing the control valve and pressure sensors as disclosed. Power is supplied to the wiring circuit through lines L1 and L2. Line L1 is connected by wire 222 to compressor contactor normally open contact C-1, to normally open refrigerant solenoid valve contacts RS1-1, to normally open refrigerant solenoid contacts RS2-1, to normally open refrigerant solenoid contacts RS3-1, to normally open defrost relay contacts DFR-1 and to master control 210. Line L2 is connected via wire 224 to normally open compressor relay contacts C-2, to the three liquid line solenoids LLS-1, LLS-2 and LLS-3; to the three suction line solenoid valves SLS-1, SLS-2 and SLS-3, to reversing valve solenoid RVS, to cooling relay CR and to transformer 205. Wire 226 connects normally open compressor contactor C-1 to compressor motor 200 of compressor 10 and which is connected by wire 228 to normally open compressor contacts C-2. Wire 230 connects normally open refrigerant solenoid contacts RS1-1 to liquid line solenoid LLS-1 and suction line solenoid SLS-1. Wire 232 connects normally open refrigerant solenoid contacts RS2-1 to liquid line solenoid contacts LLS-2 and suction line solenoid contacts SLS-2. Wire 234 connects normally open refrigerant solenoid contacts RS3-1 to liquid line solenoid LLS-3 and suction line solenoid SLS-3. Wire 236 connects normally open defrost relay contacts DFR-1 and normally closed defrost relay contacts DFR-2 to reversing valve solenoid RVS. Wire 238 connects master control 210, normally closed defrost relay contacts DFR-2 and cooling relay CR. Wire 240 connects master control 210 to the primary of transformer 205.

In the control wiring portion of the schematic the secondary of transformer 205 is connected to wire 244 and 242. Wire 244 is connected to defrost relay DFR, compressor relay C, first unloader solenoid V1, second unloader solenoid V2, control valve solenoid CVS to microprocessor 220 and to refrigerant solenoids RS1, RS2 and RS3.

Wire 242 is connected from the secondary of transformer 205 to microprocessor 220 and to normally open compressor relay contacts CR-7. The CR-7 normally open contacts are connected by wire 268 to microprocessor 220.

Wires 262 and 260 connect the cooling capacity pressure sensor CPS-L corresponding to pressure sensor 52 to microprocessor. Wires 264 and 266 connect the heating capacity pressure sensor CPS-L corresponding to pressure sensor 54 to microprocessor 220. Wire 246 connects the defrost relay to the microprocessor. Wire 248 connects the microprocessor to the low pressure switch which is connected by wire 250 to the high pressure switch which is connected by wire 252 to the compressor relay C. Wire 254 connects unloader solenoid V1 to the microprocessor. Wire 256 connects unloader solenoid V2 to the microprocessor. Wire 258 connects control valve solenoid CVS to microprocessor 220.

Connected to the thermostat wherein one of the indoor heat exchangers is located are wires 276 and 278, connected to the thermostat where another of the indoor heat exchangers are located are wires 280 and 282, and connected to the thermostat where a third indoor heat exchanger is located are wires 284 and 286. Wire 276 is connected to normally open cooling relay contacts CR-1 which is connected by wire 270 to the microprocessor and to refrigerant solenoid RS-1. Wire 278 is connected through normally closed cooling relay contacts CR-2 to wire 270.

Wire 280 is connected to normally open cooling relay contacts CR-3 which are connected by wire 272 to the microprocessor and to refrigerant solenoid RS2. Wire 282 connects to normally closed cooling relay contacts CR-4 to wire 272 and to refrigerant solenoid RS2.

Wire 284 connects the normally open cooling relay contacts CR-5 which are connected by wire 274 to the microprocessor, to normally closed cooling relay contacts CR-6 and to refrigerant solenoid RS-3. Wire 286 connects to normally closed cooling relay contacts CR-6.

OPERATION—CONTROL CIRCUIT

When the master control is placed in the cooling mode of operation energy is supplied through normally closed defrost relay contacts DFR-2 to energize reversing valve solenoid RVS which energizes reversing valve 16 to place it in the appropriate position to direct refrigerant from the compressor to the outdoor heat exchanger. Additionally cooling relay CR is energized which acts to close contacts CR-7 indicating to the microprocessor that the cooling relay is energized. Additionally, cooling relay contacts CR-1, CR-3 and CR-5 all close connecting the wire indicating a cooling need from the respective indoor locations, wires 276, 280 and 284, to the appropriate refrigerant solenoids RS1, RS2 and RS3. Hence, should a demand occur at any of the thermostats a signal will be sent through these wires, and through these now closed cooling relay contacts to energize the appropriate refrigerant solenoids. Since the cooling relay contacts CR-2, CR-4 and CR-6 are normally closed, the energization of the cooling relay opens these contacts preventing a demand for heating as might flow along wires 278, 282 and 286 from energizing refrigerant solenoids RS1, RS2 or RS3. Once a refrigerant solenoid is energized, such as refrigerant solenoid RS1, the normally open refrigerant solenoid contacts RS1-1 close thereby energizing the liquid line solenoid and the suction line solenoid corresponding thereto referenced as LLS-1 and SLS-1. Hence, the solenoid valves to this refrigeration circuit are open such that refrigerant flows to the indoor heat exchanger corresponding thereto. The other two refrigerant solenoids operate in like manner to energize the appropriate liquid line and suction line solenoid valves (90, 94, 98, 116, 120, and 124).

When the unit is in the heating mode of operation the master control is placed in the heat position and the cooling relay is not energized. In this mode of operation the defrost relay, upon energization, will close defrost relay contacts DFR-1 energizing the reversing valve solenoid to place the unit in the cooling mode of operation to effect defrost. In the meantime, normally closed defrost relay contacts DFR-2 will open preventing energization of a cooling relay. The defrost relay is energized through the microprocessor.

With the master control in the heating mode of operation the cooling relay is not energized and the cooling relay contacts remain in the position as shown in the drawing. Hence, any call for cooling in wires 276, 280 or 284 is ignored and only calls for heating in wires 278, 282 and 286 act to energize the refrigerant solenoids RS1, RS2 and RS3. They, in like turn as in cooling, act to open the appropriate liquid line and suction line solenoids to allow refrigerant flow to the appropriate heat exchanger.

It can be additionally seen that the microprocessor is connected to control unloaders 40 and 42 of the refrigerant circuit through suction unloader solenoids V1 and V2 controlled through wires 254 and 256. Additionally, control valve 50 is controlled through the control valve solenoid CVS which is energized through wire 258.

Both the heating capacity pressure sensor and the cooling capacity pressure sensor are connected directly to the microprocessor such that a change in state in either one may be detected by the microprocessor to effect the appropriate logic as shown in the detailed logic flow charts accompanying herewith.

The combination of the refrigerant circuit, the electric circuit and flow charts as disclosed herein all act to describe a multi-indoor heat exchanger refrigeration circuit wherein capacity steps of the compressor are changed by utilizing a single control valve to connect pressure sensors to high and low pressure. This single control valve acts to provide high pressure or low pressure to the various capacity pressure sensors to have the pressure sensor determine whether or not the pressure level is within a predetermined range or whether a capacity change is needed because the pressure level has exceeded that range. The control valve additionally acts to reset the pressure sensor by applying either a high or low pressure to the pressure sensor as needed to effect reset. Since the heating pressure sensor and the cooling pressure sensor operate in different pressure levels the operation of one will not affect the operation of the other and the pressure applied to one may be applied to both without any adverse impact. The control logic also acts to only sense a pressure signal from the sensor appropriate for the mode of operation of the unit.

Hence, a system for supplying multiple capacity step control utilizing but a single pressure sensor for heating and a single pressure sensor for cooling and a single control valve for supplying pressure to the pressure sensors and for supplying pressure to reset the pressure sensors has been described. A simple, reliable and effective system for effecting control has been detailed.

The invention has been described herein with reference to a particular embodiment. It is to be understood by those skilled in the art that variations and modifications can be effected within the spirit and scope of the invention.

What is claimed is:

1. A refrigeration circuit including an outdoor heat exchanger, an indoor heat exchanger and variable capacity compressor means, a discharge line connected to the variable capacity compressor means for receiving refrigerant at high pressure and a suction line connected to the compressor means for conducting refrigerant to the compressor at a relatively lower pressure, and means for changing the capacity of the compressor means which comprises:

a capacity pressure switch means for indicating a need to effect a change in the capacity of the compressor upon a selected refrigerant pressure level being detected;

a control valve connected via a high pressure conduit to direct refrigerant between the discharge line and the control valve, connected via a low pressure conduit to direct refrigerant between the suction line and the control valve and a sensing conduit connecting the control valve to the capacity pressure switch means, said control valve acting to connect either the high pressure conduit to the sensing conduit or to connect the low pressure conduit to the sensing conduit; and a control means interconnected to effect a change in the capacity of the compressor means upon the capacity pressure switch means indicating a need to effect a change in the capacity of the compressor means.

2. The apparatus as set forth in claim 1 wherein the capacity pressure switch means further comprises a pressure responsive switch capable of being reset, said switch responding to a sensed change in pressure to change from a first state to a second state to indicate a need to effect a change in capacity of the compressor means and said switch responding to a reverse change in pressure to change from the second state back to the first state.

3. The apparatus as set forth in claim 2 wherein the control valve is positioned to connect one of the pressure conduits to the pressure switch means when it is desired to sense a pressure change to indicate a need to effect a capacity change and connects the other of said pressure conduits to the pressure switch means to provide a distinct pressure level for effecting reset of the pressure switch means after the pressure switch means has indicated a need to effect a capacity change.

4. The apparatus as set forth in claim 3 wherein when the refrigeration circuit is configured to transfer heat energy from the indoor heat exchangers to the outdoor heat exchangers the control valve connects the low pressure conduit to the pressure switch means, said pressure switch means changing state when the pressure sensed drops below a selected level, said control valve being positioned to connect the high pressure conduit to the sensing conduit after the pressure switch changes state to reset the pressure switch to the first state.

5. The apparatus as set forth in claim 3 wherein when the refrigeration circuit is configured to transfer heat energy from the outdoor heat exchanger to the indoor heat exchangers the control valve is positioned to connect the high pressure conduit to the pressure switch means through the sensing conduit, said pressure switch means changing from a first state to a second state upon a predetermined pressure level being achieved and said pressure switch being reset from the second state to the first state by repositioning the control valve to connect the low pressure conduit to the sensing conduit.

6. A reversible refrigeration circuit for transferring heat energy between an outdoor heat exchanger, and an indoor heat exchanger including a variable capacity compressor for circulating refrigerant through the refrigeration circuit, a reversing valve, a discharge line for receiving high pressure refrigerant from the compressor, and a suction line for conducting low pressure refrigerant to the compressor which comprises:

a high pressure conduit connected to the discharge line;

a low pressure conduit connected to the suction line;

a heating capacity pressure switch which changes from a first state to a second state upon detecting a predetermined pressure level to indicate a need to change the capacity of the compressor;

a cooling capacity pressure switch which changes from a first state to a second state upon detecting a predetermined pressure level to indicate a need to change the capacity of the compressor;

a sensing conduit connected to both the heating pressure switch and the cooling pressure switch;

a control valve connected to the high pressure conduit, the low pressure conduit and the sensing conduit to connect either the low pressure conduit or the high pressure conduit to the sensing conduit; and control means for regulating the position of the control valve and the capacity of the compressor in response to the heating capacity pressure switch and the cooling capacity pressure switch.

7. The apparatus as set forth in claim 6 wherein when the refrigeration circuit is in a cooling mode of operation such that heat energy is being transferred from the indoor heat exchanger to the outdoor heat exchanger the control valve will be positioned to connect the low pressure conduit to the sensing conduit such that the low pressure switch may detect a drop in suction pressure below a predetermined level and change from a first state to a second state indicating a need to decrease compressor capacity.

8. The apparatus as set forth in claim 7 wherein the low pressure switch may be reset from the second state to the first state by applying a relatively high pressure to the switch, said high pressure being applied by placing the control valve in position to connect the high pressure conduit to the sensing conduit whereby the low pressure switch is reset and is capable of detecting a subsequent need to reduce the capacity of the compressor.

9. The apparatus as set forth in claim 6 wherein when the refrigeration circuit is in the heating mode of operation such that heat energy is being transferred from the outdoor heat exchanger to the indoor heat exchanger the control valve will be positioned to connect the high pressure conduit to the sensing conduit such that the high pressure switch may detect an increase in the discharge pressure above a predetermined level and change from a first state to a second state indicating a need to decrease compressor capacity.

10. The apparatus as set forth in claim 9 wherein the high pressure switch may be reset from the second state to the first state by applying low pressure to the high pressure switch, said low pressure being applied by repositioning the control valve to connect the low pressure conduit to the sensing conduit whereby the high pressure switch is reset to be capable of detecting a subsequent need to decrease compressor capacity.

11. The apparatus as set forth in claim 6 wherein the refrigeration circuit includes multiple indoor heat exchangers and wherein the compressor has at least one capacity step for each indoor heat exchanger.

12. A method of regulating the capacity of a variable capacity compressor forming a portion of a refrigeration circuit said compressor discharging high pressure refrigerant and receiving low pressure refrigerant which comprises the steps of:

sensing a pressure level within the refrigeration circuit;

indicating a need to effect a compressor capacity change based upon the sensed pressure level not being within a desired pressure range;

changing the capacity of the compressor in response to the step of indicating; and resetting the step of sensing after the step of changing such that a further capacity change may be affected based upon the sensed pressure level not being within the same range.

13. The method as set forth in claim 12 and further comprising the step of:

applying refrigerant pressure levels to the step of sensing; and switching between high pressure and low pressure locations within the refrigeration circuit such that the applied pressure level to the step of sensing may be varied.

14. The method as set forth in claim 13 wherein the step of resetting further comprises switching the applied pressure level being sensed.

15. The method as set forth in claim 14 wherein the steps of switching further comprises applying low pressure levels to the step of sensing when the refrigeration circuit is in the cooling mode of operation and applying high pressure levels to the step of sensing when the refrigeration circuit is in the heating mode of operation.

16. A method using a single level pressure sensor of regulating the capacity of a multiple capacity compressor having a discharge line at a relatively high pressure and a suction line at relatively low pressure all part of a refrigeration circuit which comprises the steps of:

applying a pressure level from either the discharge line or the suction line to the pressure sensor;

determining if the pressure sensor changes from a first state to a second state indicating that a predetermined pressure level has been exceeded and that there is a need to change the capacity of the compressor;

regulating the compressor capacity in response to the state of the pressure sensor; and coupling a pressure level from either the suction line or the discharge line to the pressure sensor to reset the sensor from the second state to the first state such that a subsequent need to change the compressor capacity may be detected by the sensor determining if the same pressure level has been exceeded.

17. The method as set forth in claim 16 wherein the refrigeration circuit is reversible for supplying either heating or cooling and includes a cooling pressure sensor and a heating pressure sensor and wherein the step of applying a pressure further comprises applying the pressure level from the discharge line to the heating pressure sensor in the heating mode and applying the pressure level from the suction line to the cooling pressure sensor in the cooling mode of operation.

18. The method as set forth in claim 16 wherein the step of coupling further comprises coupling the pressure level from the discharge line to the cooling pressure sensor to reset the cooling pressure sensor and coupling the pressure level from the suction line to the heating pressure sensor to reset the heating pressure sensor.

19. The method as set forth in claim 16 including switch means connected to the discharge line, suction line, the heating pressure sensor and the cooling pressure sensor and wherein the step of applying includes:

positioning the switch means to communicate the pressure level from one of the discharge line or suction line to both the heating pressure sensor and the step of coupling includes;

positioning the switch means to communicate the pressure level from one of the discharge line or the suction line to both the heating pressure sensor and the cooling pressure sensor.

* * * * *